US005826342A

United States Patent [19]

Zuro

[11] Patent Number: 5,826,342

[45] Date of Patent: Oct. 27, 1998

[54] VEHICLE WINDSHIELD REMOVING TOOL

[75] Inventor: Mark E. Zuro, Salt Lake City, Utah

[73] Assignee: Equalizer Industries, Inc., Round Rock, Tex.

[21] Appl. No.: 692,115

[22] Filed: Aug. 5, 1996

[51] Int. Cl.[6] ..... B26B 3/00

[52] U.S. Cl. ..... 30/279.2; 30/280; 30/287; 30/294

[58] Field of Search ..... 30/280, 294, 309, 30/314, 317, 340, 342, 169, 279.2, 287

[56] References Cited

U.S. PATENT DOCUMENTS

| | | | |
|---|---|---|---|
| 1,244,746 | 10/1917 | Kinzel | 30/314 |
| 1,319,484 | 10/1919 | Nichols | 30/317 |
| 1,546,975 | 7/1925 | Feller | 30/317 X |
| 2,602,995 | 7/1952 | Hurt | 30/287 |
| 3,241,236 | 3/1966 | Capps | 30/287 |
| 4,199,852 | 4/1980 | Ayers et al. | 30/294 X |
| 4,694,576 | 9/1987 | Cothery | 30/280 |
| 4,980,976 | 1/1991 | Junginger et al. | 30/272.1 |
| 4,989,320 | 2/1991 | Borkott et al. | 30/169 X |
| 5,038,478 | 8/1991 | Mezger et al. | 30/294 X |

FOREIGN PATENT DOCUMENTS

| | | | |
|---|---|---|---|
| 177992 | 1/1962 | Sweden | 30/314 |

OTHER PUBLICATIONS

Sommer & Maca—since 1920 pp. 62,63,66,,67,19 Title "Windshield Cut–Out Knives".

Magazine "Auto Glass"—pp. 6, 13, 14 and 33, May/Jun. 1996.

*Primary Examiner*—Eugenia Jones

*Attorney, Agent, or Firm*—Thorpe, North & Western, LLP

[57] ABSTRACT

A vehicle windshield removing tool includes a handle for gripping by the user, and a blade extending from the handle for insertion between the vehicle windshield and the vehicle or gasket holding the windshield. The blade includes a base portion which is mounted in the handle to extend outwardly therefrom and a cutting portion which is formed into an inverted U-shaped terminal end which is used to cut the adhesive or bonding material between the windshield and the molding by sliding the U-shaped terminal end about the perimeter of the windshield, with the windshield edge being positioned and sliding within the U-shaped portion of the blade.

8 Claims, 1 Drawing Sheet

VEHICLE WINDSHIELD REMOVING TOOL

BACKGROUND OF THE INVENTION

This invention relates to a tool for severing or cutting the bond between automotive vehicle windshields and the vehicle, or the moldings or gaskets in which they are fitted in the vehicle.

Automotive vehicle windshields are typically held in place in the vehicle either by a urethane adhesive (directly to the vehicle) or by at least a partially resilient molding or gasket fitted in the windshield opening of the vehicle body and secured to the body. The gasket is typically formed to include an inwardly facing channel for receiving the edge of the windshield and preventing the windshield from being pushed either outwardly from the vehicle or inwardly. To further secure the windshield in the channel of the molding or gasket, an adhesive or bonding material is placed in the channel either before or after the windshield is installed to thus further secure the windshield in place in the gasket.

It is necessary from time to time to remove a windshield from a vehicle either to replace it or, in some instances, repair it. Then, either a new windshield would be installed or the repaired windshield reinstalled.

In order to remove a windshield, it is necessary to cut or sever the bond between the windshield and the vehicle, or the gasket, and a number of different tools have been suggested for doing this. Typically, such tools include a blade extending outwardly from a handle for a short distance (base portion of the blade) and then at a right angle to the base portion (terminal portion). The terminal portion is fitted between the windshield and the vehicle, or the gasket, both from the inside of the vehicle and inside surface of the windshield and then outside the vehicle on the outside surface of the windshield, to thereby cut or sever the bond and release or allow release of the windshield. Unfortunately, in the process of "cutting out" the windshield from the vehicle, or molding or gasket, the molding or gasket is oftentimes damaged beyond repair or reuse, requiring the installation of a new molding or gasket. Further, it can be quite time consuming to first cut about the perimeter of the windshield on the outside and then on the inside, or vice versa. Finally, with some vehicle designs, a cowling or pan is positioned near the perimeter of the windshield and gasket at the bottom of the windshield, making it difficult to get access and to and cut the windshield from the gasket.

SUMMARY OF THE INVENTION

It is an object of the invention to provide a new and easy-to-use tool for use in removing a windshield from a vehicle.

It is also an object of the invention to provide such a tool which enables removal of a vehicle windshield from the outside.

It is a further object of the invention to provide such a tool whose use reduces the time and effort required to remove a windshield.

It is still another object of the invention to provide such a tool capable of severing the bond between the edge of the windshield and the vehicle, or molding or gasket with a single pass around the edge of the windshield.

The above and other objects of the invention are realized in a specific illustrative embodiment of a vehicle windshield removing tool which includes a handle portion for gripping by a user, and a blade having a base portion mounted on the handle to extend outwardly therefrom and a cutting portion 12 extending forwardly from the base portion and then curving rearwardly to form a U-shaped terminal end, with sharpened lateral edges.

In accordance with one aspect of the invention, the cutting portion of the blade tapers from a larger width near the base portion, to a narrower width at the terminus of the blade.

In use, the blade is inserted between the edge of the windshield and the vehicle, or molding or gasket, so that the windshield edge is received into the U-shaped cutting portion. Then, when the blade is moved along the edge of the windshield, the adhesive or bonding material is severed to release the windshield from the vehicle and/or the gasket to allow easy removal thereof.

BRIEF DESCRIPTION OF THE DRAWING

The above and other objects, features and advantages of the invention will become apparent from a consideration of the following detailed description presented in connection with the accompanying drawing in which.

DETAILED DESCRIPTION

Figure 1:
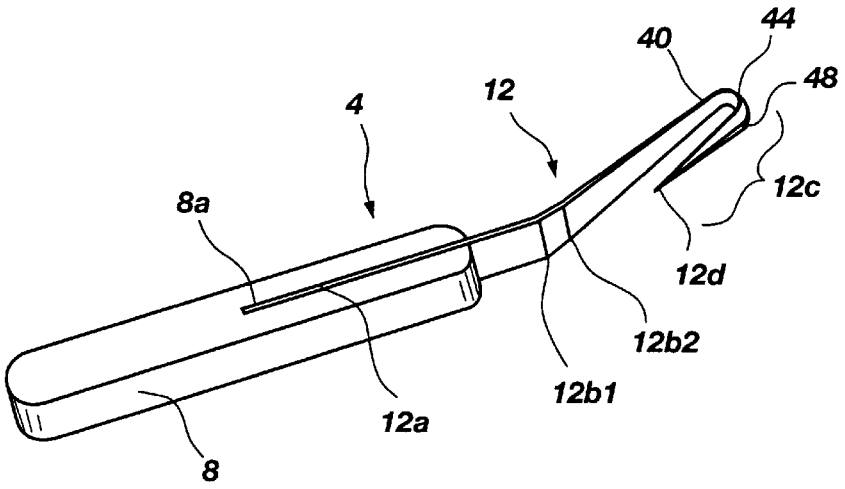
FIG. 1 is a perspective view of a vehicle windshield removing tool made in accordance with the principles of the present invention.
Figure 2:
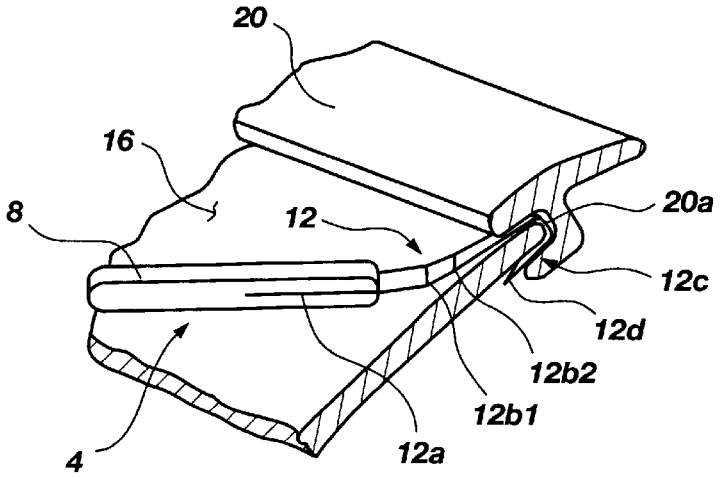
FIG. 2 shows the tool of the present invention inserted between a vehicle windshield and a molding or gasket holding the windshield.

Referring to FIGS. 1 and 2, there is shown a perspective view of a tool 4 made in accordance with the present invention. The tool 4 includes a handle 8 for gripping by a user. The handle 8 could take a variety of sizes and shapes to enable a user to firmly grip the handle when using the tool, and could be made of a variety of materials including plastic, wood, hard rubbers, etc.

Extending from a forward end of the handle 8 is a blade 12. The blade 12 includes a base portion 12*a* which, in the embodiment of FIGS. 1 and 2, is fitted into a slot 8*a* of the handle 8. The base portion 12*a* extends forwardly of the handle 8 to a pair of bends 12*b*1 and 12*b*2 at which locations the blade bends rearwardly and then extends substantially straight to a cutting portion 12*c* of the blade. The cutting portion 12*c* is formed in the shape of an inverted U, as shown, and the blade terminates in a point 12*d*. The bends 12*b*1 and 12*b*2 are each about 20 degrees from the forward direction such that the angle of the first bend 12*b*1 is about 20 degrees from the longitudinal axis of the handle and the angle of the second bend 12*b*2 is about 40 degrees from the longitudinal axis of the handle.

Figure 3:
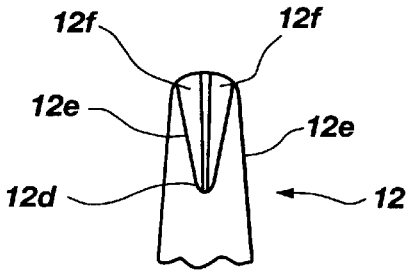
FIG. 3 shows a fragmented, front view of the blade of the tool of FIGS. 1 and 2.

FIG. 3 shows a fragmented, front view of the blade 12 which illustrates the tapering of the blade gradually to the point 12*d*. FIG. 3 also shows that lateral edges 12*e* of the blade 12 are beveled (12*f*) so that the lateral edges are sharpened. As stated above, these sharpened lateral edges 12*e* make up the U-shaped cutting portion 12*c* of the blade. As shown in FIG. 1, the cutting portion 12*c* is made up of three sections, a first section 40 extending forwardly from the handle 8, a second section 44 forming the "U" portion of the blade, and a third section 48 where the blade gradually tapers to the point 12*d*.

The blade 12 may advantageously be made of hardened steel, stainless steel or other alloy of iron. The width or separation of the sides of the U-shaped terminal end 12*c* is about ¼ inch, but could be selected to be any appropriate separation to enable the removal of various thickness windshields.

In use, the cutting portion or terminal end 12*c* of the blade 12 is inserted between a windshield 16 and a gasket or molding 20 (or vehicle directly) in which the edge of the windshield 16 is inserted into a channel 20*a* of the molding (FIG. 2). The blade 12 is inserted between the windshield 16 and molding 20 so that the edge of the windshield is received into the U-shaped terminal end, as shown in FIG. 2. In this position, the blade 12 is slid along the edge of the windshield 16 to sever any adhesive or bonding between the windshield and molding and thus allow release of the windshield. Effectively, the blade 12 may be inserted between the windshield 16 and molding 20 (or vehicle itself) from the outside and then moved about the entire perimeter of the windshield to "cut away" the windshield from the molding (or vehicle). The tool enables such cutting away with essentially little or no damage to the molding or gasket 20 so that it may be used again. Also, since the windshield may be cut away from the outside of the vehicle and performs a complete cutting of adhesive or bonding material on both sides of the windshield, only one pass of the tool about the perimeter of the windshield is required. Finally, the construction, shape and angle of the blade 12 allows for cutting away the windshield without the need to remove any "cowl" or "pan" from certain vehicles on which that equipment is installed, and which make the edge of the windshield "inaccessible".

In the manner described, a simple, easy-to-use and yet effective windshield removal tool is provided which, among other things, allows removal of a windshield with little or no damage to any molding or gasket holding the windshield. Thus, in addition to reducing the time necessary to remove the windshield, the cost is also reduced since the existing gasket or molding is typically saved.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A vehicle windshield removing tool comprising a handle portion for gripping by a user, a blade having a base portion mounted on the handle portion to extend outwardly therefrom and a cutting portion having a first section extending forwardly from the base portion, a second section curving approximately 90 degrees from the first section, and a third section extending from the second section in a direction opposite the first section, said first, second, and third sections forming an inverted U-shaped terminal end, the first, second and third sections being formed with sharpened side cutting edges, said handle portion has a longitudinal axis, wherein said base portion is elongate and fitted in the handle portion to be co-linear therewith and extend outwardly from one end thereof, said base portion of said blade further comprises a first bend spaced-apart from a second bend, with the angle of the first bend being about 20 degrees from the longitudinal axis of the handle portion and the angle of the second bend being about 40 degrees from the longitudinal axis of the handle portion.

2. A tool as in claim 1 wherein the cutting portion of the blade tapers from a larger width near the base portion, to a narrower width at a terminus of the blade.

3. A tool as in claim 2 wherein the terminus of the blade is pointed.

4. A tool as in claim 1 wherein the blade tapers to a point at an end of the third section of the U-shaped terminal end and the point on the third section is spaced apart from the first section of the U-shaped terminal end approximately ¼ inch.

5. A vehicle windshield removing tool comprising a handle portion for gripping by a user, and a blade having a base portion mounted on the handle portion to extend outwardly therefrom and a cutting portion having a first section extending forwardly from the base portion, a second section curving approximately 90 degrees from the first section, and a third section extending from the second section in a direction opposite the first section, said first, second, and third sections forming an inverted U-shaped terminal end, the first section, the second section, and the third section being formed with sharpened side cutting edges along the U-shaped terminal end, the first section being spaced apart from the third section approximately ¼ inch, wherein said handle portion has a longitudinal axis, said base portion being elongate and fitted in the handle portion to be co-linear therewith and extend outwardly from one end thereof, the base portion of the blade comprises a first bend spaced-apart from a second bend, with the angle of the first bend being about 20 degrees from the longitudinal axis of the handle portion and the angle of the second bend being about 40 degrees from the longitudinal axis of the handle portion and in the same plane as the first bend.

6. A tool as in claim 5 wherein the blade tapers to a point at an end of the third section and the point is about ¼ inch apart from the first section.

7. A tool as in claim 5 wherein the cutting portion of the blade tapers from a larger width near the base portion, to a narrower width at a terminus of the blade.

8. A tool as in claim 7 wherein the terminus of the blade is pointed.

* * * * *